US009327538B2

(12) United States Patent
Munro et al.

(10) Patent No.: US 9,327,538 B2
(45) Date of Patent: May 3, 2016

(54) BRAGG DIFFRACTING SECURITY MARKERS

(75) Inventors: Calum H. Munro, Wexford, PA (US); Mark D. Merritt, State College, PA (US); Sean Purdy, Allison Park, PA (US)

(73) Assignee: PPG Industries Ohio, Inc., Cleveland, OH (US)

( * ) Notice: Subject to any disclaimer, the term of this patent is extended or adjusted under 35 U.S.C. 154(b) by 2252 days.

(21) Appl. No.: 11/325,998

(22) Filed: Jan. 5, 2006

(65) Prior Publication Data

US 2007/0165903 A1 Jul. 19, 2007

(51) Int. Cl.

| | |
|---|---|
| ***B42D 15/00*** | (2006.01) |
| ***B42D 15/10*** | (2006.01) |
| ***B41M 3/10*** | (2006.01) |
| ***B42D 25/29*** | (2014.01) |
| ***B44F 1/10*** | (2006.01) |
| ***B41M 3/14*** | (2006.01) |

(52) U.S. Cl.

CPC ..... *B41M 3/10* (2013.01); *B41M 3/148* (2013.01); *B42D 25/29* (2014.10); *B44F 1/10* (2013.01); *B42D 2035/20* (2013.01)

(58) Field of Classification Search

USPC ..... 283/67, 70, 72, 101, 901

See application file for complete search history.

(56) References Cited

U.S. PATENT DOCUMENTS

| | | | | |
|---|---|---|---|---|
| 4,856,857 | A * | 8/1989 | Takeuchi et al. | 283/72 |
| 6,337,131 | B1 | 1/2002 | Rupaner et al. | |
| 6,482,489 | B1 | 11/2002 | Otaki et al. | |
| 6,782,115 | B2 | 8/2004 | Decker et al. | |
| 6,894,086 | B2 | 5/2005 | Munro et al. | |
| 7,220,535 | B2 * | 5/2007 | Lawandy et al. | 283/72 |
| 7,923,097 | B2 * | 4/2011 | Heim et al. | 283/72 |
| 2002/0054680 | A1 | 5/2002 | Huang et al. | |
| 2003/0016718 | A1 | 1/2003 | Toda et al. | |
| 2003/0125416 | A1 * | 7/2003 | Munro et al. | 523/171 |
| 2004/0005453 | A1 | 1/2004 | Leyrer et al. | |
| 2004/0131799 | A1 | 7/2004 | Arsenault et al. | |
| 2004/0253443 | A1 | 12/2004 | Anselmann et al. | |
| 2004/0266560 | A1 | 12/2004 | Andre et al. | |
| 2005/0094265 | A1 | 5/2005 | Wang | |
| 2005/0095417 | A1 | 5/2005 | Jiang | |

(Continued)

FOREIGN PATENT DOCUMENTS

| | | | |
|---|---|---|---|
| EP | 1247820 | A1 | 10/2002 |
| JP | 2002128600 | A | 5/2002 |

(Continued)

OTHER PUBLICATIONS

H. Fudouzi & Y. Xia, "Photonic Papers and Inks: Color Writing with Colorless Materials", Advanced Materials, 2003, pp. 892-896, 15, No. 11, Wiley-VCH Veriag GmbH & Co. KGaA, Weinheim.

(Continued)

*Primary Examiner* — Alexander P Taousakis
*Assistant Examiner* — Justin V Lewis
(74) *Attorney, Agent, or Firm* — Julie W. Meder

(57) ABSTRACT

A method of marking an article with a watermark that diffracts radiation according to Bragg's law is disclosed. The watermark includes a periodic array of particles fixed in a matrix. The watermark may change colors with viewing angle, disappear and reappear with viewing angle or may diffract non-visible radiation that is detectable at certain angles of detection.

28 Claims, 5 Drawing Sheets

(56) References Cited

U.S. PATENT DOCUMENTS

| | | | |
|---|---|---|---|
| 2005/0228072 | A1 | 10/2005 | Winkler et al. |
| 2008/0251222 | A1 | 10/2008 | Krietsch et al. |

FOREIGN PATENT DOCUMENTS

| | | | | |
|---|---|---|---|---|
| JP | 2002344047 | A | | 11/2002 |
| WO | WO 01/90260 | A2 | | 11/2001 |
| WO | 0244726 | A2 | | 6/2002 |
| WO | 02084340 | A1 | | 10/2002 |
| WO | 03025035 | A2 | | 3/2003 |
| WO | 03025538 | A2 | | 3/2003 |
| WO | 03/062900 | A1 | | 7/2003 |
| WO | 03106557 | A1 | | 12/2003 |
| WO | WO 2005015271 | A2 | * | 2/2005 |
| WO | 2007042131 | A1 | | 4/2007 |

OTHER PUBLICATIONS

"Bragg-Gleichung" url: http://de.wikipedia.org/wiki.Bragg-Gleichung, retrieved on Nov. 21, 2012, 2 pages.

Jiang et al., "Large-Scale Fabrication of Wafer-Size Colloidal Crystals, Macroporous Polymers and Nanocomposites by Spin-Coating", Journal of American Chemical Society, 2004, pp. 13778-13786, vol. 126, No. 42.

Fudouzi et al., "Colloidal Crystal with Tunable Colors and Their Use as Photonic Papers", Langmuir, 2003, pp. 9653-9660, vol. 19, No. 23.

* cited by examiner

BRAGG DIFFRACTING SECURITY MARKERS

FIELD OF THE INVENTION

This invention relates to watermarks produced from radiation diffractive materials and to their use as security devices. The present invention further relates to methods of producing a watermark, where the watermark may or may not require use of an optical device to retrieve or view the watermark.

BACKGROUND OF THE INVENTION

Holograms are often employed to provide some degree of document security. Many bankcards carry a holographic image including an image of the authentic card user so that the identity of that user can be verified. Holograms are also imbedded within security documents so that they are invisible to the unaided eye. To verify or authenticate such documents, the hologram is irradiated with light of a suitable wavelength. Depending on the wavelength used, the holographic image can either be viewed directly or it can be sensed using suitable imaging techniques. While holograms provide an initial level of security, the techniques to produce holograms are becoming readily available such that a hologram may be copied thereby limiting the value of holograms. Conventional watermarks such as the images of a manufacturer's logo that are pressed onto paper or the watermarks of currency notes can also be reproduced.

For documents distributed electronically, digital watermarks have been employed. A digital watermark may be an invisible signal that is overlaid into an electronic file. The overlay may contain critical information or hidden information which is only retrievable by the rightful recipient in position of the proper decoder. A digital watermark may be imbedded in an electronic document. When someone attempts to copy and use the electronic document, the digital watermark is copied therewith and is evidence that the document was copied from the original. Alternatively, alteration of a document can destroy the digital watermark and make the content invalid.

Conventional optical watermarks use optical devices such as photocopiers to retrieve the watermark. An optical watermark can be a combination of an organization's logo and words to indicate ownership of a document. If there is an attempt to photocopy a printed document with the optical watermark, the copied document will show the watermark illustrating that the document is not the original. Optical watermarks are particularly useful to protect print documents from unauthorized reproduction.

While optical watermarks that rely upon optical devices such as photocopiers to retrieve the watermark are suitable for loose paper documents, a need remains for security devices applied to paper or plastic substrates such as those used in packaging for retail products. A consumer seeking assurances that a packaged product was actually produced by a particular manufacturer may not have access to optical devices for testing the packaging of a product.

SUMMARY OF THE INVENTION

The present invention includes a method of marking an article with a radiation watermark including steps of applying an ordered periodic array of particles to an article in a configuration that marks the article, wherein the array diffracts radiation at a detectable wavelength. The present invention further includes a method of making an article exhibiting images including steps of applying a periodic array of particles onto the article in a configuration of an image, coating the array of particles with a matrix composition, and fixing the coated array of particles such that the image is detectable upon diffraction of radiation by the fixed array. Also included in the present invention is a method of making an article exhibiting an image including steps of applying at least one matrix composition to the article in a configuration of an image, forming a periodic array of particles, embedding the array of particles within the matrix composition to coat the particles, and fixing the coated array of particles such that the image is detectable upon diffraction of radiation by the fixed array.

DETAILED DESCRIPTION OF THE INVENTION

Figure 1:
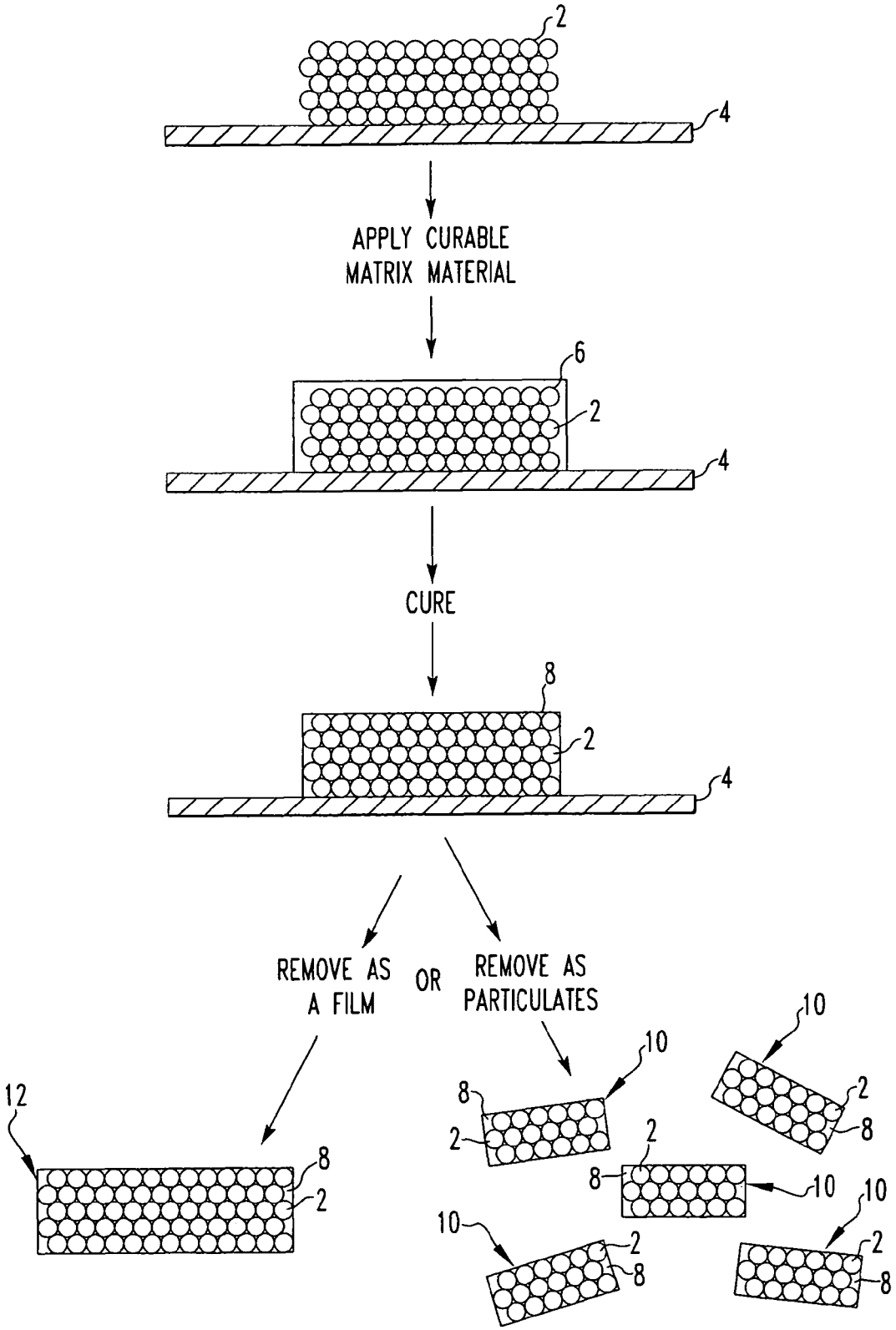
FIG. 1 is a schematic flowchart of methods of producing radiation watermarks.

The present invention includes a method of marking a product with a radiation watermark by applying an ordered periodic array of particles to an article, wherein the array diffracts radiation at a wavelength whereby the array functions as a watermark. Radiation watermark refers to a marking (such as a graphic design, lettering or the like) that is detectable as an image upon irradiation. References herein to a watermark of the present invention relate to such a radiation watermark unless otherwise stated. The watermark may appear at one viewing angle and disappear at another viewing angle or may change color with viewing angle. Watermarks of the present invention also may diffract radiation outside the visible light spectrum. The array may be produced on an article or may be in the form of a sheet for applying to an article. Alternatively, the array may be in particulate form for applying to an article in a coating composition such as a paint or ink. An article having a watermark produced according to the present invention may authenticate the source of the product, identify the product or be decorative.

The present invention includes a method of producing a radiation watermark, where the watermark may or may not require use of an optical device to retrieve or view the watermark. The watermark of the present invention may be a detectable image that may authenticate or identify an article to which it is applied, or it may be decorative. The image is detectable by exposing the image to radiation and detecting radiation reflected from the image. Each of the exposing radiation and the reflected radiation may be in the visible or non-visible spectrum. The watermark used in the present invention is produced from a radiation diffraction material composed of an ordered periodic array of particles that diffracts radiation according to Bragg's law.

The radiation diffractive material includes an ordered periodic array of particles held in a polymeric matrix. An ordered periodic array of particles refers to an array of closely packed particles that diffract radiation according to Bragg's law. Incident radiation is partially reflected at an uppermost layer of particles in the array at an angle θ to the plane of the first layer and is partially transmitted to underlying layers of particles. Some absorption of incident radiation occurs as well. The portion of transmitted radiation is then itself partially reflected at the second layer of particles in the array at the angle θ and partially transmitted to underlying layers of particles. This feature of partial reflection at the angle θ and partial transmission to underlying layers of particles continues through the thickness of the array. The wavelength of the reflected radiation satisfies the equation:

$$m\lambda=2nd\sin\theta$$

where (m) is an integer, (n) is the effective refractive index of the array and (d) is the distance between the layers of particles. The effective refractive index (n) is closely approximated as a volume average of the refractive index of the materials of the array, including matrix material surrounding the particles. For generally spherical particles, the dimension (d) is the distance between the planes of the centers of particles in each layer and is proportional to the particle diameter. In such a case, the reflected wavelength λ is also proportional to the particle diameter.

The matrix material in which the particles are held may be an organic polymer such as a polystyrene, a polyurethane, an acrylic polymer, an alkyd polymer, a polyester, a siloxane-containing polymer, a polysulfide, an epoxy-containing polymer, and/or a polymer derived from an epoxy-containing polymer.

The particles may have a unitary structure and may be composed of a material different from the matrix, and may be chosen from the same polymers as the matrix material and may also be inorganic material such as a metal oxide (e.g. alumina, silica or titanium dioxide) or a semiconductor (e.g. cadmium selenide).

Alternatively, the particles may have a core-shell structure where the core may be produced from the same materials as the particles described above. The shell may be produced from the same polymers as the matrix material, with the polymer of the particle shell differing from each of the core material and the matrix material for a particular array of the core-shell particles. The shell material is non-film-forming whereby the shell material remains in position surrounding each particle core without forming a film of the shell material such that the core-shell particles remain as discrete particles within the polymeric matrix. As such, the array in certain embodiments includes at least three general regions, namely, the matrix, the particle shell and the particle core. Typically, the particles are generally spherical with the diameter of the core constituting 80 to 90% of the total particle diameter or 85% of the total particle diameter with the shell constituting the balance of the particle diameter and having a radial thickness dimension. The core material and the shell material have different indices of refraction. In addition, the refractive index of the shell may vary as a function of the shell thickness in the form of a gradient of refractive index through the shell thickness. The refractive index gradient is a result of a gradient in the composition of the shell material through the shell thickness.

In one embodiment of the invention, the core-shell particles are produced by dispersing core monomers with initiators in solution to produce core particles. Shell monomers are added to the core particle dispersion along with an emulsifier or surfactant whereby the shell monomers polymerize onto the core particles.

In one embodiment shown in FIG. 1, the particles 2 (either unitary structure or core-shell structure) are fixed in the polymeric matrix 6 by providing a dispersion of the particles 2 bearing a similar charge in a carrier, applying the dispersion onto a support 4, evaporating the carrier to produce an ordered periodic array of the particles 2 on the support 4, coating the array of particles 2 with monomers or other polymer precursor materials 6, and curing the polymer 8 to fix the array of particles 2 within the polymer 8. The dispersion may contain 10 to 70 vol. % of the charged particles 2 or 30 to 65 vol. % of the charged particles 2. The support 4 may be a flexible material (such as a polyester film) or an inflexible material (such as glass). The dispersion can be applied to the support 4 by dipping, spraying, brushing, roll coating, curtain coating, flow coating or die coating to a desired thickness, to a maximum thickness of 20 microns or a maximum of 10 microns or a maximum of 5 microns.

For radiation diffractive material having the core-shell particles, upon interpenetration of the array with a fluid matrix 6 monomer composition, some of the monomers of the matrix 6 may diffuse into the shells, thereby increasing the shell thickness (and particle diameter) until the matrix 6 composition is cured. Solvent may also diffuse into the shells and create swelling. The solvent is ultimately removed from the array, but this swelling from solvent may impact the final dimensions of the shell. The length of time between interpenetration of monomers into the array and curing of the monomers in part determines the degree of swelling by the shells.

A watermark of the radiation diffractive material may be applied to an article in various ways. The radiation diffractive material may be removed from the support 4 and comminuted into particulate form, such as in the form of flakes 10. The comminuted radiation diffraction material may be incorporated as an additive in a coating composition such as a paint or ink for applying to an article. A coating composition containing comminuted radiation diffractive material can be applied to an article using conventional techniques (painting, printing, silk screening, writing or drawing or the like) to create an image on the substrate in discreet locations or to coat a substrate.

Figure 2:
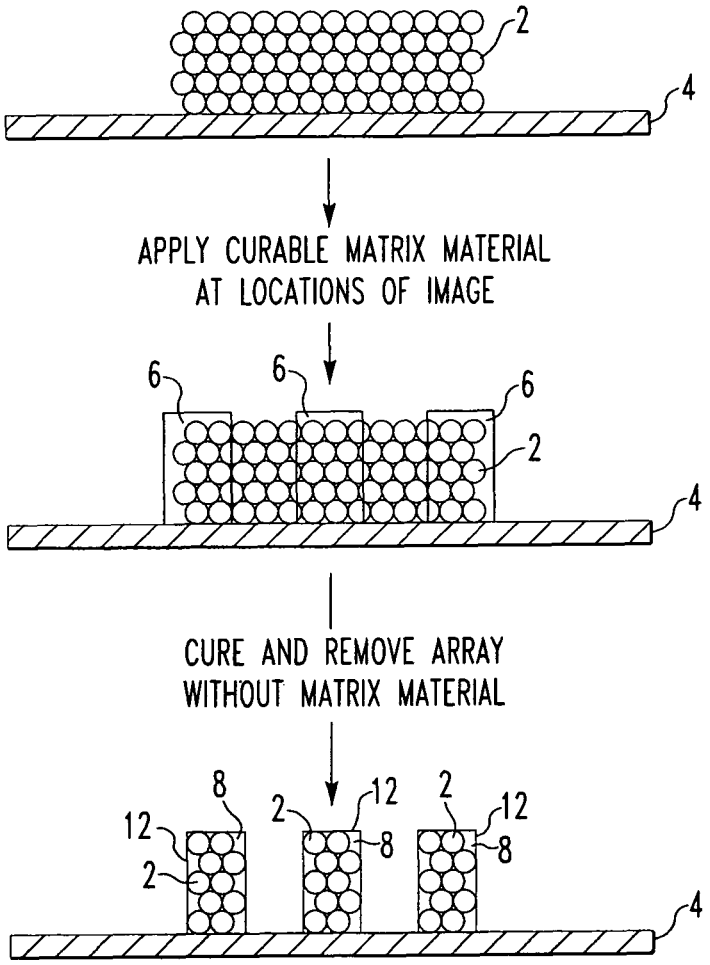
FIG. 2 is a schematic flowchart of a method of producing a radiation watermark using discreet application of matrix material.
Figure 3:
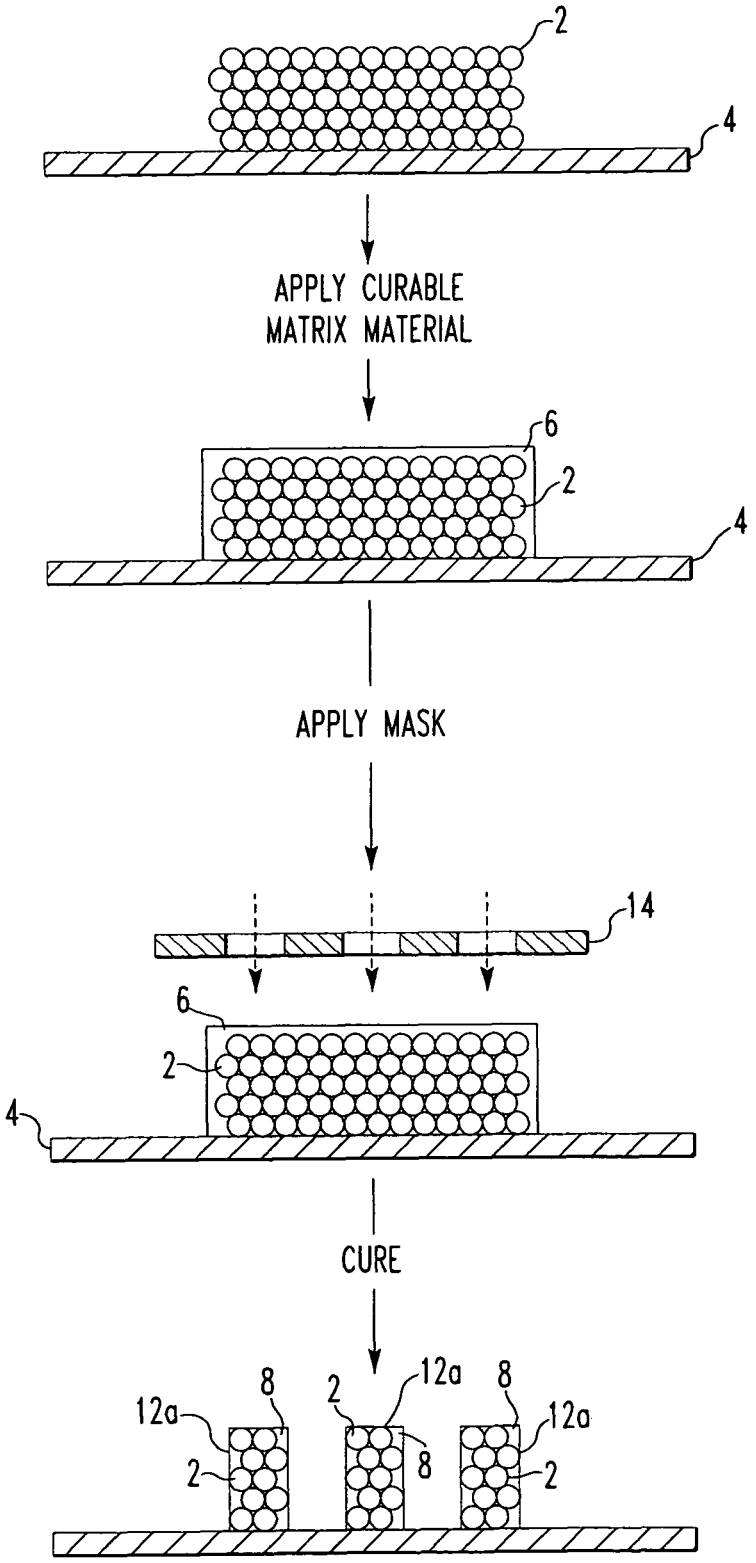
FIG. 3 is a schematic flowchart of a method of producing a radiation watermark with curing through a mask.

Alternatively, the radiation diffractive material may be produced in the form of a sheet or film 12. The film 12 of radiation diffractive material may then be applied to an article such as with an adhesive such as by hot stamping. For a film 12 of radiation diffractive material applied to an article, the watermark may be detected as a region of the article that diffracts radiation. As shown in FIG. 2, to create an image (such as a decoration and/or lettering) in a film 12, the radiation diffractive material may be produced in the form of the desired image by producing the ordered periodic array on the production substrate 4 and applying the matrix material 6 only in the location of the desired image and curing the matrix material 6. The portions of the array that are not coated with the matrix material 6 are not fixed to the production substrate and may be removed, yielding only the coated array 12 in the configuration of an image. The coated array 12 is then removed from the production substrate as a film 12 for application to an article. Another technique for creating an image in a film 12*a* shown in FIG. 3 includes applying the array of particles 2 and polymerizable matrix material 6 to the production substrate 4 with curing of the matrix 6 effected through a mask 14 only in the location of the desired image. Radiation curable matrix material 6 (such as UV curable polymer 8) is particularly suitable for use with an exposure mask 14. The uncured matrix material 6 with the particles 2 therein is then removed to yield a cured radiation diffractive material 12*a* in the form of the image.

A watermark produced according to the present invention may diffract radiation in a single wavelength band. To produce a watermark that diffracts radiation at multiple bands of wavelengths (such as to create a plurality of colors in the detectable image), different radiation diffractive materials may be used within the watermark. A shift in the wavelength of diffracted light can be achieved by changing the particle size (particle size of spherical particles being proportional to diffraction wavelength) or by changing the effective refractive index of the radiation diffractive material (effective refractive index of the radiation diffractive material being proportional to diffraction wavelength). The effective refractive index of the radiation diffractive material can be altered by selecting a particular curable matrix material. For example, using a single particle type and applying different matrix materials to discreet locations results in differing effective refractive indexes. For particles having a unitary structure (not core-shell), a watermark refracting radiation at multiple wavelength bands may be produced by using a plurality of radiation diffractive materials in different locations of the image. For example, a watermark exhibiting two colors of diffracted visible light at a particular viewing angle may be produced by applying a first radiation diffractive material having one particle size yielding a red appearance and applying a second radiation diffractive material having a smaller particle size yielding a green appearance. In this manner, a multi-colored watermark may be produced by applying a plurality of different radiation diffractive materials as an image on an article.

Figure 4:
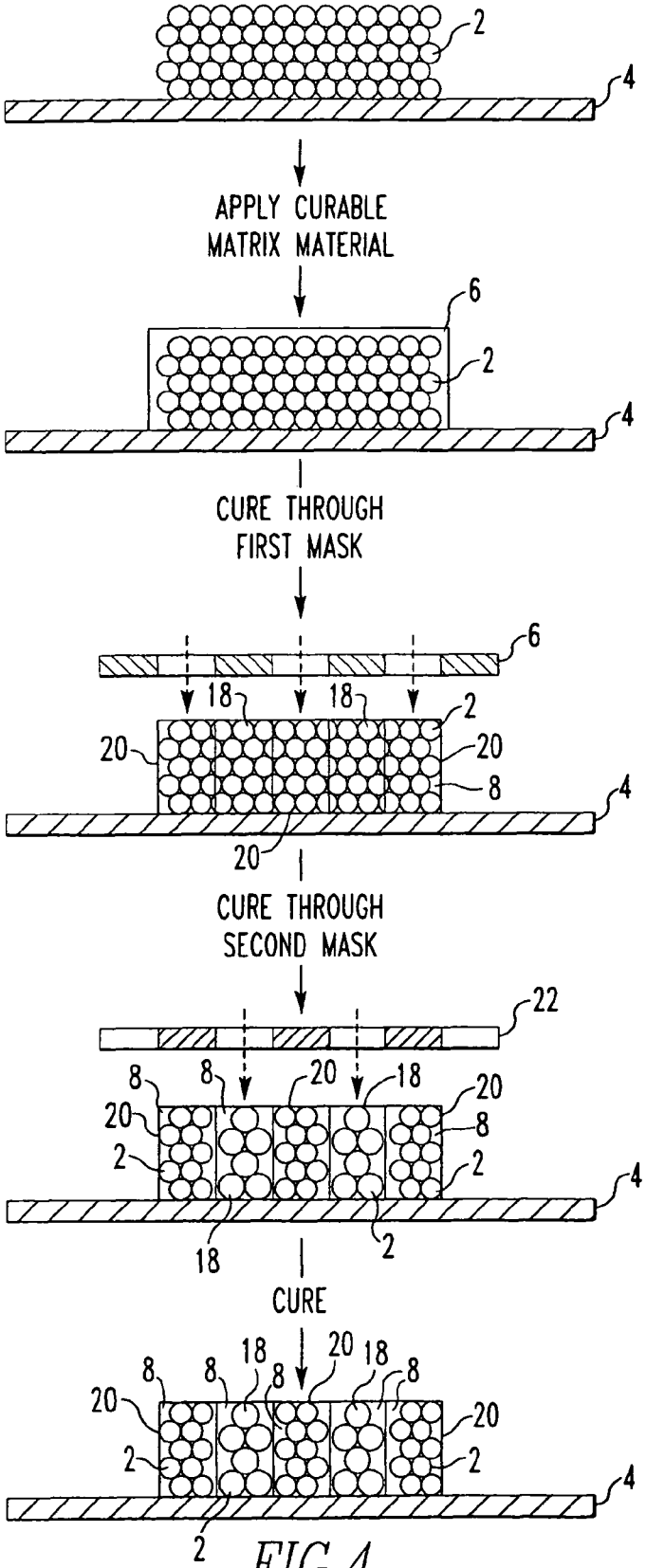
FIG. 4 is a schematic flowchart of a method of producing a radiation watermark having variable Bragg diffracting properties using swellable particles.

In another embodiment, the wavelength of diffracted radiation may be shifted to produce an image that diffracts radiation at a plurality of bands of wavelengths by using the above-described core-shell particles. The cure time for certain portions of the radiation diffractive material can be adjusted so that components of the matrix material (e.g. monomers and solvent) are allowed to diffuse into certain portions of the radiation diffractive material for varying periods of time, thereby varying the particle shell thicknesses. An increase in particle shell thickness results in increased particle diameter and increased interparticle distance, thereby increasing the wavelength of diffracted radiation. The cure times for portions of the radiation diffractive material can be altered as shown in FIG. 4 by using various imaging masks to create regions of varying cure time. Core-shell particles 2 are applied to production support 4 and are coated with radiation polymerizable matrix material 6. A first curing step is achieved by exposure through a first mask 16. The particles 2 in unexposed portions 18 are not fixed; matrix material 6 continues to diffuse into the shells thereby swelling the particles 2 so that the dimensions of the particles 2 in unexposed portions 18 are greater than the particle dimensions in exposed portions 20. Unexposed portions 18 are cured through a second mask 22. The resulting film includes portions 18 and 20 having different particle dimensions that refract radiation at different wavelength bands. More than two curing masks may be used to create more than two portions of differing particle dimensions. The regions having varying cure times result in regions of varying radiation diffractive properties. In this manner, a watermark can be produced from one particle type where the wavelength of diffracted radiation varies within the watermark. For a watermark diffracting visible radiation, the watermark can appear multi-colored using one type of core-shell particles.

Figure 5:
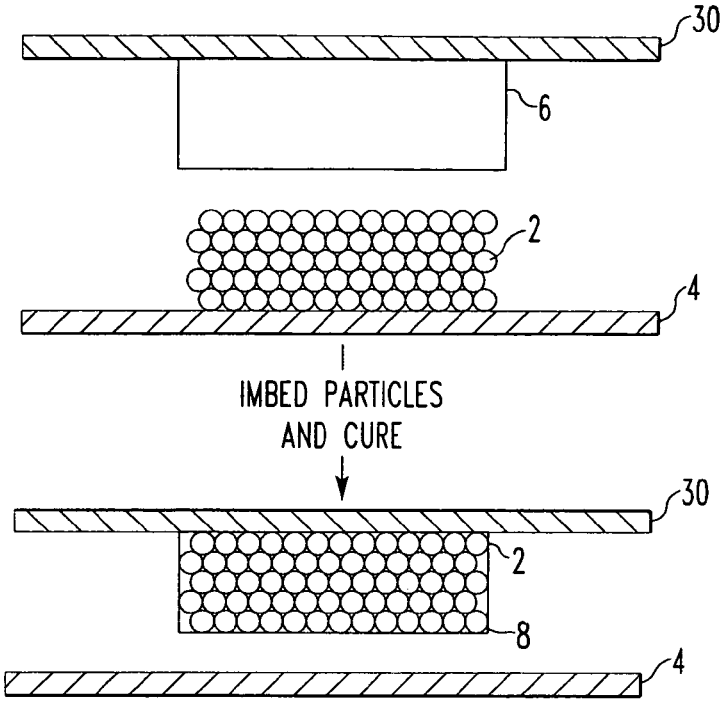
FIG. 5 is a schematic flowchart of a method of producing a radiation watermark by embedding particles into a matrix material.

In another embodiment shown in FIG. 5, the watermark is produced in situ on an article 30. A dispersion of particles 2 bearing a similar charge in a carrier is applied to a substrate 4 and the carrier is evaporated to produce an ordered array of particles 2 on the substrate 4. A matrix material 6 is applied to the article 30, and the array of particles 2 on the substrate 4 is contacted with the matrix material 6 by urging the substrate 4 towards the article 30 to embed the array of particles 2 into the matrix material 6. The matrix material 6 is cured to fix the array within the matrix material 6. The matrix material 6 may be applied to the article 30 in the configuration of the image. Upon embedding the particle array into matrix material 6, the array is retained on the article 30 only in the locations of the matrix material 6. Alternatively, an image may be formed by curing the matrix material 6 through a mask 14 to cure only the image area. The uncured matrix material 6 does not adhere to the article 30 and is removed yielding the radiation diffraction material only in the image area. A watermark produced by embedding an array of particles 2 into matrix material 6 on an article 30 may refract a single wavelength band of radiation. As described above with reference to producing radiation diffraction material that is applied to an article, in order to achieve diffraction at multiple wavelength bands, different arrays of particles having different particle sizes or different refractive indices may be embedded into the matrix material. When core-shell particles are used in the array, the shells may be selectively swollen by components of the matrix material by adjusting the cure time for the matrix material using imaging masks to create regions of varying cure time as described above.

Figure 6:
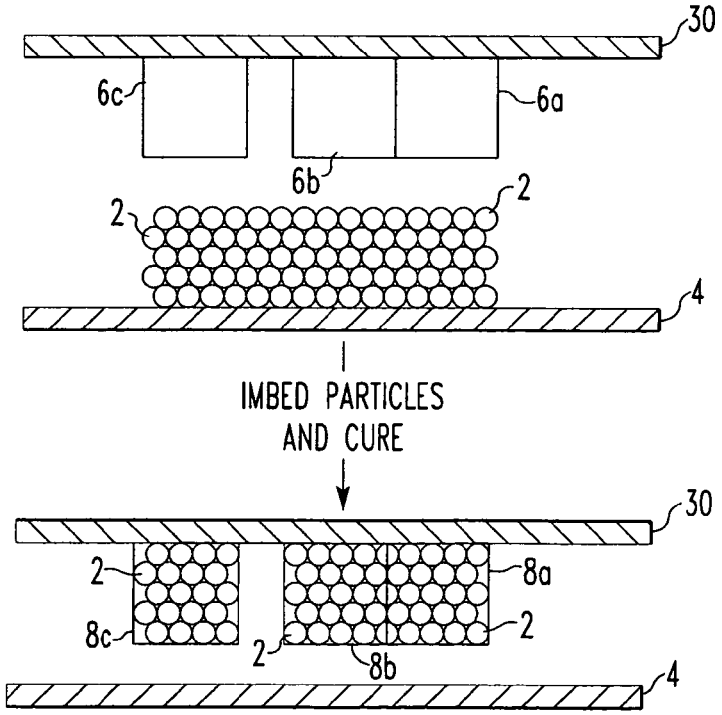
FIG. 6 is a schematic flowchart having variable Bragg diffracting properties by embedding particles into a plurality of matrix materials.

Regions of varying wavelengths of refraction may also be produced by altering the effective refractive index of the radiation refractive material. For a single array of particles and a refractive index thereof, the effective refractive index may be changed by using matrix materials of differing refractive index. Referring to FIG. 6, by way of example, a plurality of matrix materials 6*a*, 6*b* and 6*c* having varying refractive indices may be applied to an article 30 by a conventional printing process used for multi-color printing such as ink jet printing. An array of particles 2 is embedded into the various matrix materials 6*a*, 6*b* and 6*c*, and the matrix materials are cured in a single step yielding polymers 8*a*, 8*b* and 8*c* having differing refractive indices. The effective refractive indices of the coated arrays in the locations of polymers 8*a*-8*c* differ such that the coated arrays exhibit differing Bragg diffraction properties.

The above-described embodiments are not meant to be limiting. Watermarks of the present invention may be produced using a combination of particle sizes, particle types (core-shell or not) and matrix materials in a combination of processes involving applying matrix to an array of particles on an article or embedding an array of particles into matrix material applied to an article. For example, a plurality of types of particles having differing light diffracting properties may be applied to a substrate or article and fixed in place in separate arrays. The resulting plurality of fixed arrays exhibits different light diffracting properties (e.g. colors on face and on flop) on a single substrate or article.

The watermark of the present invention may be used as a security marker. The watermark diffracts radiation at a first wavelength band when viewed from a first angle (e.g., on face to a substrate bearing the watermark) and diffracts radiation at a second wavelength band when viewed from a second angle (e.g., on flap to the substrate). The diffracted radiation at each viewing angle may be in the visible spectrum or outside the visible spectrum. For example, at the first viewing angle ($\theta$ of Bragg's law), the watermark appears colorless (diffracts radiation outside the visible spectrum) or is otherwise undetected. The watermark may be viewed by altering the viewing angle (θ of Bragg's law) to yield wavelengths of diffracted radiation that are detectable in the visible spectrum (as color) or detectable outside the visible spectrum. A colorless wavelength band may be detected if a spectrophotometer (or other device for detecting radiation) is preset to only detect radiation of certain wavelengths.

A watermark that changes color with viewing angle can be used similar to a hologram as a security marker. The user manipulates the article bearing the watermark to confirm the presence and proper appearance of the watermark. A watermark that changes from exhibiting color to being colorless can be used similarly. Such watermarks that Bragg diffract in the visible spectrum are particularly suited for marking consumer products to authenticate the source of the products. A watermark that diffracts radiation solely outside the visible spectrum may be used as an optical fingerprint authenticating the substrate to which it is applied. Watermarks functioning outside the visible spectrum would not interfere or alter the appearance of a product. Instead, such products may be tested for exhibiting a fingerprint of diffracted radiation to identify the product.

As used herein, unless otherwise expressly specified, all numbers such as those expressing values, ranges, amounts or percentages may be read as if prefaced by the word "about", even if the term does not expressly appear. Any numerical range recited herein is intended to include all sub-ranges subsumed therein. Plural encompasses singular and vice versa. Also, as used herein, the term "polymer" is meant to refer to prepolymers, oligomers and both homopolymers and copolymers; the prefix "poly" refers to two or more.

These exemplary uses of radiation diffractive materials as watermarks are not meant to be limiting. In addition, the following examples are merely illustrative of the present invention and are not intended to be limiting.

EXAMPLES

Example 1

Organic Matrix

An ultraviolet radiation curable organic composition was prepared via the following procedure. Diphenyl(2,4,6-trimethylbenzoyl)phosphine oxide and 2-hydroxy-2-methyl-propiophenone (0.3 g), in a 50/50 blend from Aldrich Chemical Company, Inc., Milwaukee, Wis., was added with stirring to 10 g of propoxylated (3) glyceryl triacrylate from Sartomer Company, Inc., Exton, Pa.

Example 2

Organic Matrix with Swelling Solvent

An ultraviolet radiation curable organic composition was prepared via the following procedure. Diphenyl(2,4,6-trimethylbenzoyl)phosphine oxide and 2-hydroxy-2-methyl-propiophenone (0.3 g), in a 50/50 blend from Aldrich Chemical Company, Inc. and 1.4 g acetone was added with stirring to 10 g of propoxylated (3) glyceryl triacrylate from Sartomer Company, Inc.

Example 3

Organic Matrix for Hot Stamping

An ultraviolet radiation curable organic composition was prepared via the following procedure. Diphenyl(2,4,6-trimethylbenzoyl)phosphine oxide and 2-hydroxy-2-methyl-propiophenone (22.6 g), in a 50/50 blend from Aldrich Chemical Company, Inc. in 227 g ethyl alcohol, were added with stirring to 170 g of 2(2-ethoxyethoxy) ethyl acrylate, 85 g of CN968 (urethane acrylate) and 85 g of CN966J75 (urethane acrylate) blended with 25% isobornyl acrylate, all from Sartomer Company, Inc.

Example 4

Organic Matrix for Overcoating

An ultraviolet radiation curable organic composition was prepared via the following procedure. Diphenyl(2,4,6-trimethylbenzoyl)phosphine oxide and 2-hydroxy-2-methyl-propiophenone (0.15 g), in a 50/50 blend from Aldrich Chemical Company, Inc. was added with stirring to 5 g of ethoxylated (3) bisphenol A diacrylate from Sartomer Company, Inc.

Example 5

Organic Matrix for Particulate Production

An ultraviolet radiation curable organic composition was prepared via the following procedure. Diphenyl(2,4,6-trimethylbenzoyl)phosphine oxide and 2-hydroxy-2-methyl-propiophenone (22.6 g), in a 50/50 blend from Aldrich Chemical Company, Inc. in 615 g ethyl alcohol, were added with stirring to 549 g of propoxylated (3) glyceryl triacrylate, 105.3 g of pentaerythritol tetraacrylate and 97.8 g of ethoxylated (5) pentaerythritol tetraacrylate all from Sartomer Company, Inc.

Example 6

Core/Shell Particles

A dispersion of polystyrene-divinylbenzene core/styrene-methyl methacrylate-ethylene glycol dimethacrylate-divinylbenzene shell particles in water was prepared via the following procedure. 2.4 g of sodium bicarbonate from Aldrich Chemical Company, Inc. was mixed with 2045 g deionized water and added to a 4-liter reaction kettle equipped with a thermocouple, heating mantle, stirrer, reflux condenser and nitrogen inlet. The mixture was sparged with nitrogen for 40 minutes with stirring and then blanketed with nitrogen. Aerosol MA80-I (22.5 g in 205 g deionized water) from Cytec Industries, Inc., was added to the mixture with stirring followed by a 24 g deionized water rinse. The mixture was heated to approximately 50° C. using a heating mantle. Styrene monomer (416.4 g), available from Aldrich Chemical Company, Inc., was added with stirring. The mixture was heated to 60° C. Sodium persulfate from the Aldrich Chemical Company, Inc. (6.2 g in 72 g deionized water) was added to the mixture with stirring. The temperature of the mixture was held constant for 40 minutes. Under agitation, divinylbenzene from Aldrich Chemical Company, Inc., (102.7 g) was added to the mixture and the temperature was held at approximately 60° C. for 2.3 hours. Sodium persulfate from the Aldrich Chemical Company, Inc. (4.6 g in 43.2 g deionized water) was added to the mixture with stirring.

A mixture of styrene (103 g), methyl methacrylate (268 g), ethylene glycol dimethacrylate (9 g) and divinylbenzene (7 g), all available from Aldrich Chemical Company, Inc., was added to the reaction mixture with stirring. Sipomer COPS-I (3-Allyloxy-2-hydroxy-1-propanesulfonic acid 41.4 g) from Rhodia, Inc., Cranbury, N.J., was added to the reaction mixture with stirring. The temperature of the mixture was maintained at 60° C. for approximately 4.2 hours. The resulting polymer dispersion was filtered through a five-micron filter bag. This process was repeated one time. The two resulting polymer dispersions were then ultrafiltered using a 4-inch ultrafiltration housing with a 2.41-inch polyvinylidine fluoride membrane, both from PTI Advanced Filtration, Inc., Oxnard, Calif., and pumped using a peristaltic pump at a flow rate of approximately 170 ml per second. Deionized water (3002 g) was added to the dispersion after 3000 g of ultrafiltrate had been removed. This exchange was repeated several times until 10388.7 g of ultrafiltrate had been replaced with 10379 g deionized water. Additional ultrafiltrate was then removed until the solids content of the mixture was 44.1 percent by weight.

The material was applied via slot-die coater from Frontier Industrial Technology, Inc., Towanda, Pa. to a polyethylene terephthalate (PET) substrate and dried at 180° F. for 30 seconds to a porous dry thickness of approximately 7 microns. The resulting product diffracted light at 552 nm measured with a Cary 500 spectrophotometer from Varian, Inc.

Example 7

Core/Shell Particles

Polystyrene-divinylbenzene core/styrene-methyl methacrylate-ethylene glycol dimethacrylate-divinylbenzene shell particles were prepared via the method described in Example 6, except 23.5 g Aerosol MA80-I was used instead of 22.5 g. The material was deposited on a PET substrate and diffracted light at 513 nm measured with a Cary 500 spectrophotometer from Varian, Inc.

Example 8

Core/Shell Particles

Polystyrene-d ivinylbenzene core/styrene-methyl methacrylate-ethylene glycol dimethacrylate-divinylbenzene shell particles were prepared via the method described in Example 6, except 26.35 g Aerosol MA80-I was used instead of 22.5 g. The material was deposited on a PET substrate and diffracted light at 413 nm measured with a Cary 500 spectrophotometer from Varian, Inc.

Example 9

Core/Shell Particles

Polystyrene-divinylbenzene core/styrene-methyl methacrylate-ethylene glycol dimethacrylate-divinylbenzene shell particles were prepared via the method described in Example 6 except 24.0 g Aerosol MA80-I was used instead of 22.5 g. The material was deposited on a PET substrate and diffracted light at 511 nm measured with a Cary 500 spectrophotometer from Varian, Inc.

Example 10

Particulate Core/Shell Arrays

Polystyrene-d ivinyl benzene core/styrene-methyl methacrylate-ethylene glycol dimethacrylate-divinylbenzene shell particles deposited on a PET substrate were prepared via the method described in Example 6, except 23.5 g Aerosol MA80-I was used instead of 22.5 g. The material was deposited on a PET substrate and diffracted light at 520 nm measured with a Cary 500 spectrophotometer from Varian, Inc.

1389 grams of the matrix material prepared in Example 5 was applied into the interstitial spaces of the porous dried particles on the PET substrate using a slot-die coater from Frontier Industrial Technology, Inc. After application, the samples were then dried in an oven at 135° F. for 80 seconds and then ultraviolet radiation cured using a 100 W mercury lamp. This produced flexible, transparent films that, when viewed at 0 degrees or parallel to the observer, had a red color. The same films, when viewed at 45 degrees or greater to the observer, were green in color.

The films were washed two times with a 50/50 mixture of deionized water and isopropyl alcohol and were removed from the PET substrate using an air knife assembly from the Exair Corporation, Cincinnati, Ohio. The material was collected via vacuum into a collection bag. The material was ground into powder using an ultra-centrifugal mill from Retch GmbH & Co., Haan, Germany. The powder was passed through a 25 micron and a 20 micron stainless steel sieve from Fisher Scientific International, Inc. The powder in the 20 micron sieve was collected.

Example 11

Core/Shell Film for Hot Stamping

A mixture, 10% by weight, of poly(methyl methacrylate) average molecular weight of 120,000 available from Aldrich Chemical Company, Inc., in acetone was applied to one mil PET support layer via a slot-die coater from Frontier Industrial Technology, Inc. at a film thickness of approximately 250 nm. The material was then dried in an oven at 150° F. for 40 seconds. To the resulting poly(methyl methacrylate) film, material from Example 9 was deposited via a slot-die coater-and dried at 185° F. for 40 seconds to a porous dry thickness of approximately 7 microns. 580.6 grams of matrix material prepared in Example 3 were applied into; the interstitial spaces of the dried particles via a slot-die coater from Frontier Industrial Technology, Inc. After application, the samples were then dried in an. oven at 135° F. for 100 seconds and then ultraviolet radiation cured using a 100 W mercury lamp.

Example 12

Color Shifting Watermark of One Color

Two drops of the matrix material prepared in Example 1 were placed on the black portion of an opacity chart from The Leneta Company, Mahwah, N.J., that had been lightly scuffed-sanded with a very fine Scotch-Brite® pad (abrasive pad available from 3M Corp., Minneapolis, Minn.). The material on the PET substrate prepared in Example 6 was placed face down on the opacity chart so that the polystyrene-divinylbenzene core/styrene-methyl methacrylate-ethylene glycol dimethacrylate-divinylbenzene shell particles rested in the curable matrix material of Example 1, with the uncoated side of the PET substrate exposed on top. A roller was used on the top side of the PET substrate to spread out and force the curable matrix material from Example 1 into the interstitial spaces of the core/shell particles from Example 6. A mask with a transparent image area was then placed on the PET substrate over the area on the opacity chart bearing both materials from Example 1 and Example 6. The sample was then ultraviolet radiation cured through the transparent image area of the mask using a 100 W mercury lamp. The mask and the PET substrate containing the particles were then removed from the opacity chart, and the sample was cleaned with isopropyl alcohol to remove the uncured material. A film having the image corresponding to the transparent area of the mask was formed on the opacity chart. A protective clear coating was applied by adding four drops of the matrix material of Example 1 to the image. The matrix material was then covered with a piece of PET film and was spread using a roller. The sample was then ultraviolet radiation cured using a 100 W mercury lamp. The resulting image had a copper-red color when viewed parallel or 0 degrees to the observer. The same image had a green color when viewed at 45 degrees or greater to the observer.

Example 13

Color Shifting of Image Color to Colorless

A sample was prepared by the same method described in Example 12 except material from Example 8 was used instead of the material from Example 6. The resulting image had a violet color when viewed parallel or 0 degrees to the observer. The same image was colorless when viewed at 45 degrees or greater to the observer.

Example 14

Color Shifting of Image Color on Transparent Substrate

A sample was prepared by the same method described in Example 12 except the opacity chart was replaced with a 3 mil film of polyethylene terephthalate (PET). The resulting transparent image had a copper-red color when viewed parallel or 0 degrees to the observer. The same image was green when viewed at 45 degrees or greater to the observer. The perceived intensity of the color increased greatly when the film containing the image was placed over a dark object.

Example 15

Color Shifting of Multiple Colors

A sample was prepared by the same method described in Example 12 excluding the protective clear coating. This procedure was repeated two times. The first repeated process had material from Example 8 in place of material from Example 6 and was used with a second image mask. The second repeated process had material from Example 7 and was used with a third image mask. A protective clearcoat was applied by adding four drops of the matrix material from Example 1 to the image. The matrix material was then covered with a piece of PET film and was spread into a coating using a roller. The sample was then ultraviolet radiation cured using a 100 W mercury lamp. The resulting image had an area that was copper-red color when viewed parallel or 0 degrees to the observer. The same area had a green color when viewed at 45 degrees or greater to the observer. The image also contained an area that was violet color when viewed parallel or 0 degrees to the observer and colorless when viewed at 45 degrees or greater to the observer. Also on the image was an area that was green when viewed parallel or 0 degrees to the observer and blue when viewed at 45 degrees or greater to the observer.

Example 16

Color Shifting by Solvent Swelling

A sample was prepared by the same method described in Example 13 except, on some portions of the image, the matrix material from Example 2 was used instead of the matrix material from Example 1. The portions of the image that were formed with matrix material from Example 1 had a violet color when viewed parallel or 0 degrees to the observer. The same image was colorless when viewed at 45 degrees or greater to the observer. The portions of the image that were formed with matrix material from Example 2 had a blue color when viewed parallel or 0 degrees to the observer. The same image was violet when viewed at 45 degrees or greater to the observer.

Example 17

Color Shift by Refractive Index Difference

A sample was prepared by the same method described in Example 12 except on some portions of the image, matrix material from Example 4 was used instead of matrix material from Example 1. The portions of the transparent image that were formed with matrix material from Example 1 had a copper-red color when viewed parallel or 0 degrees to the observer. The same image was green when viewed at 45 degrees or greater to the observer. The resulting portions of the transparent image that were formed with matrix material from Example 4 had a red color when viewed parallel or 0 degrees to the observer. The same image was green when viewed at 45 degrees or greater to the observer.

Example 18

Hot Stamping

A waterborne adhesive from PPG Industries, Inc. was applied to the material prepared in Example 11 at a film thickness of approximately 7 microns and was dried for 3 minutes at 150° F. The material was placed adhesive side down on a black portion of an opacity chart from The Leneta Company and was hot-stamped at 250-300° F. using a Model 55 hot stamping machine from Kwikprint Mfg. Co., Inc., Jacksonville, Fla. The resulting image had a copper-red color when viewed parallel or 0 degrees to the observer. The same image was green when viewed at 45 degrees or greater to the observer.

Example 19

Silk Screening

Material from Example 10 (5 g) was stirred into 20 g of clear silkscreen medium (Golden #3690-6) from Golden Artist Colors, Inc., New Berlin, N.Y. The mixture was silk screened onto black Mi-Teintes® paper from Canson, Inc., S. Hadley, Mass. using a silk screen frame kit and a Diazo Photo Emulsion kit from Speedball Art Products Company, Statesville, N.C. The resulting image was allowed to air dry for 30 minutes and was then coated with UV-Resistant Acrylic Coating from the Krylon Products Group, Cleveland, Ohio. The resulting image had a copper-red color when viewed parallel or 0 degrees to the observer. The same image had a green color when viewed at 45 degrees or greater to the observer.

Example 20

Hand Writing

Material from Example 10 (0.2 g) was stirred into 2.5 grams of Tria™ Ink Blender from Letraset, Ltd., Kent, England. The mixture was transferred to the ink reservoir of a 0.8 mm tip Rapidograph® pen from KOH-I-NOOR® Professional Products Group, Leeds, Mass. An image was hand written onto an opacity chart from The Leneta Company, Mahwah, N.J. using the pen. The image had a copper-red color when viewed parallel or 0 degrees to the observer. The same image had a green color when viewed at 45 degrees or greater to the observer.

Whereas particular embodiments of this invention have been described above for the purposes of illustration, it will be evident to those skilled in the art that numerous variations of the details of the present invention may be made without departing from the invention as defined in the appended claims.

The invention claimed is:

1. A method of marking an article with a radiation watermark comprising:

applying an ordered periodic array of particles to an article in a configuration that marks the article, wherein the array diffracts radiation, such that radiation is reflected from the configuration as a radiation watermark at a detectable wavelength.

2. The method of claim 1 wherein the watermark appears at one viewing angle and disappears at another viewing angle.

3. The method of claim 1 wherein the watermark diffracts visible light at substantially all viewing angles.

4. The method of claim 1 wherein the array is in the form of a film.

5. The method of claim 4 wherein the film is produced separately from the article and is applied to the article.

6. The method of claim 1 wherein the array is in particulate form for applying to the article.

7. The method of claim 1 wherein the array comprises particles received within a matrix.

8. The method of claim 7 wherein the particles comprise polystyrene, polyurethane, acrylic polymer, alkyd polymer, polyester, siloxane-containing polymer, polysulfide, epoxy-containing polymer, and/or polymer derived from an epoxy-containing polymer and wherein the matrix comprises a material selected from the group consisting of polyurethane, acrylic polymer, alkyd polymer, polyester, siloxane-containing polymer, polysulfide, epoxy-containing polymer, and/or polymer derived from an epoxy-containing polymer.

9. The method of claim 8 wherein the matrix further comprises an inorganic material.

10. The method of claim 1, wherein the array comprises core-shell particles received within a matrix.

11. The method of claim 10 wherein the particle cores comprise polystyrene, polyurethane, acrylic polymer, alkyd polymer, polyester, siloxane-containing polymer, polysulfide, epoxy-containing polymer, and/or polymer derived from an epoxy-containing polymer and wherein the each of the matrix and the shell comprise polyurethane, acrylic polymer, alkyd polymer, polyester, siloxane-containing polymer, polysulfide, epoxy-containing polymer, and/or polymer derived from an epoxy-containing polymer.

12. The method of claim 11 wherein the matrix further comprises an inorganic material.

13. A method of making an article exhibiting images comprising:

applying a periodic array of particles onto the article in a configuration of an image;

coating the array of particles with a matrix composition; and fixing the coated array of particles such that the image is detectable as a radiation watermark upon diffraction of radiation by the fixed array.

14. The method of claim 13 wherein the particles are core-shell particles, the cores being substantially non-swellable and the shells being non-film forming, the method further comprising steps of:

swelling the shells by diffusing components of the matrix into the shells; and fixing at least a portion of the coated array of the core-shell particles such that the fixed portion diffracts radiation at a desired wavelength.

15. The method of claim 14, wherein the diffusing matrix components comprise polymerizable monomers.

16. The method of claim 15 wherein said fixing step comprises radiation curing the matrix monomers through a mask to fix a first portion of the coated array.

17. The method of claim 16 further comprising radiation curing the matrix monomers through another mask to fix a second portion of the coated array, such that the first and second fixed portions of the array diffract different wavelengths of radiation.

18. The method of claim 13 wherein one portion of the array is coated with a first matrix composition and another portion of the array is coated with a second matrix composition such that (i) the difference in refractive index between the particles and the matrix differs in each portion or (ii) the effective refractive index of the coated array differs in each portion or (iii) both.

19. A method of making an article exhibiting an image comprising:

applying at least one matrix composition to the article in a configuration of an image;

forming a periodic array of particles;

embedding the array of particles within the matrix composition to coat the particles; and fixing the coated array of particles such that the image is detectable as a radiation watermark upon diffraction of radiation by the fixed array.

20. The method of claim 19 wherein one portion of the array is coated with a first matrix composition and another portion of the array is coated with a second matrix composition such that (i) the difference in refractive index between the particles and the matrix differs in each portion or (ii) the effective refractive index of the coated array differs in each portion or (iii) both.

21. A method of producing an image in a crystalline colloidal array comprising:

providing an ordered array of particles received within a curable matrix composition;

curing a first portion of the matrix composition, wherein the first cured portion diffracts radiation at a first wavelength;

curing another portion of the matrix composition, wherein the other cured portion diffracts radiation at another wavelength; and exposing the array to radiation such that radiation is reflected from the array as an image.

22. The method of claim 21, further comprising curing other portions of the matrix composition, wherein each portion diffracts radiation at a wavelength that differs from the wavelength of the diffraction for the other cured portions.

23. The method of claim 21, further comprising altering the interparticle spacing in the other portion prior to curing the other portion.

24. The method of claim 21, wherein said step of curing the first portion comprises directing radiation through a mask onto the array.

25. A crystalline colloidal array exhibiting an image comprising:

an ordered array of particles received within a cured matrix composition, wherein a first portion of the array diffracts radiation at a first wavelength such that radiation is reflected from the array as an image and another portion of the array diffracts radiation at another wavelength.

26. The crystalline colloidal array of claim 25, wherein the interparticle spacing of the particles of the other portion differs from the interparticle spacing of the particles of the first portion.

27. The crystalline colloidal array of claim 26, wherein the components of the matrix composition are cured by ultraviolet radiation.

28. The crystalline colloidal array of claim 27, wherein the matrix composition comprises an acrylic polymer.

* * * * *